US008294351B2

(12) United States Patent
Yamamoto et al.

(10) Patent No.: US 8,294,351 B2
(45) Date of Patent: Oct. 23, 2012

(54) MATRIX-TYPE COLD-CATHODE ELECTRON SOURCE DEVICE

(75) Inventors: Makoto Yamamoto, Hyogo (JP); Keisuke Koga, Ehime (JP)

(73) Assignee: Panasonic Corporation, Osaka (JP)

( * ) Notice: Subject to any disclaimer, the term of this patent is extended or adjusted under 35 U.S.C. 154(b) by 56 days.

(21) Appl. No.: 12/920,011

(22) PCT Filed: Feb. 19, 2009

(86) PCT No.: PCT/JP2009/000686

§ 371 (c)(1), (2), (4) Date: Aug. 27, 2010

(87) PCT Pub. No.: WO2009/110179

PCT Pub. Date: Sep. 11, 2009

(65) Prior Publication Data

US 2011/0001421 A1 Jan. 6, 2011

(30) Foreign Application Priority Data

Mar. 4, 2008 (JP) ..... 2008-052755

(51) Int. Cl.
*H01J 1/30* (2006.01)
*H01J 1/62* (2006.01)

(52) U.S. Cl. ..... 313/483; 313/485; 313/495; 445/24; 345/76

(58) Field of Classification Search ..... 313/495–497, 313/294, 306, 309–311, 351, 346 R, 336; 427/76; 345/76; 977/163, 79; 445/24
See application file for complete search history.

(56) References Cited

U.S. PATENT DOCUMENTS

| | | | | |
|---|---|---|---|---|
| 6,288,829 | B1 * | 9/2001 | Kimura | 359/291 |
| 6,822,241 | B2 * | 11/2004 | Schut et al. | 250/398 |
| 7,183,561 | B2 | 2/2007 | Mishina et al. | |
| 7,348,531 | B2 | 3/2008 | Okuda et al. | |
| 2004/0065843 | A1 | 4/2004 | Schut et al. | |
| 2006/0072427 | A1 | 4/2006 | Kanda et al. | |
| 2007/0188090 | A1 | 8/2007 | Kimiya et al. | |
| 2011/0057555 | A1 * | 3/2011 | Yamamoto et al. | 313/310 |

FOREIGN PATENT DOCUMENTS

| | | |
|---|---|---|
| EP | 0614209 | 9/1994 |
| JP | 54-047472 | 4/1979 |
| JP | 07-006714 | 1/1995 |
| JP | 2000-048743 | 2/2000 |

(Continued)

OTHER PUBLICATIONS

International Search Report of PCT/JP2009/000686, dated Mar. 17, 2009.

*Primary Examiner* — Tracie Y Green
(74) *Attorney, Agent, or Firm* — Hamre, Schumann, Mueller & Larson, P.C.

(57) ABSTRACT

A matrix-type cold-cathode electron source device includes a mesh structure (8) on which through-holes (9) are formed and drive portions (7*a*, 7*b*). The through-hole (9) has an opening diameter of 1/N or less of the alignment pitch of electron source elements (4) and the drive portions (7*a*, 7*b*) drive the mesh structure (8) every 1/N of the alignment pitch of the electron source elements (4). Thus it is possible to increase a resolution without reducing the size of an electron source.

16 Claims, 9 Drawing Sheets

FOREIGN PATENT DOCUMENTS

| | | |
|---|---|---|
| JP | 2004-127936 | 4/2004 |
| JP | 2005-228556 | 8/2005 |
| JP | 2006-038473 | 2/2006 |
| JP | 2006-038474 | 2/2006 |
| JP | 2007-250531 | 9/2007 |
| JP | 2007-250532 | 9/2007 |
| JP | 2008-108640 | 5/2008 |
| WO | 2004-114314 | 12/2004 |

* cited by examiner

MATRIX-TYPE COLD-CATHODE ELECTRON SOURCE DEVICE

TECHNICAL FIELD

The present invention relates to a matrix-type electron source device using a cold cathode and particularly relates to a field emission display device or a sensitive image device which is made up of an electron source array having cold-cathode electron source elements arranged in a matrix, a mesh structure opposed to the electron source array with multiple through-holes arranged thereon, and a target opposed to the electron source array via the mesh structure and configured to perform a predetermined operation in response to electron beams emitted from the electron source array through the through-holes of the mesh structure.

BACKGROUND ART

A high melting metal such as tungsten and molybdenum is formed into projections and an electric field is applied to the ends of the projections in a vacuum from the outside, so that electrons induced to the ends of the metal are emitted to the outside. Generally, the metal projections are called emitters and the emission of electrons from the emitters is called field emission or field radiation.

Elements for emitting electrons through the field emission are called field-emission electron source elements or cold-cathode electron source elements and have been recently used in various fields. For example, the elements are used as the electron sources of electron microscopes instead of hot filaments of the prior art, and are used as fluorescent display tubes that are opposed to electron source elements and emit light from phosphors by drawing electrons into anode electrodes on which phosphor films are formed.

In many cases, emitters have small structures and a single emitter cannot obtain a sufficient amount of current. Thus a group of emitters is used to obtain a sufficient amount of current. In the present specifications, a group of emitters is called "cold-cathode electron source elements".

Further, field emission displays have become practical in which cold-cathode electron source elements are arranged in a matrix to constitute a cold-cathode electron source array, anode electrodes on which phosphors corresponding to RGB are formed are disposed on the opposed side, and electrons through field emission are drawn to the anode electrodes so as to emit light from the phosphors. The following will describe, as an example, an FED using Spindt-type emitters shown in FIGS. 9 and 10.

The FED is configured such that a cathode substrate 101 and an anode substrate 111 are opposed to each other.

On the surface of the cathode substrate 101, stripe emitter signal wires 102*a* are formed in parallel and a gate insulating film 103 is formed so as to cover the emitter signal wires 102*a*. On the surface of the gate insulating film 103, stripe gate signal wires 104*a* are formed so as to cross the emitter signal wires 102*a*.

On the gate signal wires 104*a* and the gate insulating film 103, a plurality of openings 104*b* are formed in a region where the gate signal wires 104*a* and the gate insulating film 103 cross the emitter signal wires 102*a*. In the respective openings 104*b*, emitters 105 are formed so as to be disposed on the emitter signal wires 102*a*. The openings 104*b* on the surfaces of the gate signal wires 104*a* act as gate electrodes. An electric field is applied to the gate electrodes 104*b* through the gate signal wires 104*a*, so that electrons can be emitted from the ends of the emitters 105. A region where the multiple emitters 105 and the gate electrodes (=the openings 104*b*) are formed is called a cold-cathode electron source element region.

The anode substrate 111 has a surface opposed to the cathode substrate 101, and an anode electrode 112 made up of a transparent conductive film (ITO) is formed over the opposed surface of the anode substrate 111. On the anode electrode 112, phosphors 113R, 113G, and 113B of red, green, and blue are sequentially formed in stripe. The phosphors 113R, 113G, and 113B are formed in parallel with the gate signal wires 104*a* formed on the cathode substrate 101.

In the FED configured thus, electron emission from the multiple electron source elements arranged in a matrix is sequentially controlled based on output signals from a video circuit, so that a desired image can be displayed on the surface of the anode substrate 111.

In the same configuration, a photoelectric conversion film (not shown) may be formed instead of the phosphors 113R, 113G, and 113B on the surface of the anode substrate 111, so that image elements can be configured to read hole-electron pairs, which have been induced by external light, by electrons emitted from electron source elements.

In an FED and an image element, light emission or the resolution of imaging is determined depending upon the area of electrons on the surface of an anode electrode, the electrons having been emitted from an electron source element. Thus in order to obtain an FED and an image element with a high resolution, a solution is to reduce the area of the electron emission surface of an electron source element. However, when an electron source element is excessively reduced in area, an emission current decreases and a necessary amount of current cannot be obtained.

Further, electrons from the cold-cathode electron source are not all emitted straight to the anode electrode 112 but are expanded to a certain degree. This is because the ends of the emitters 105 constituting the electron source each have a certain radius of curvature in the manufacturing process. Since electrons are emitted perpendicularly to a curvature surface, electron beams are emitted so as to spread to a certain degree.

For this reason, in order to obtain electron beams spreading with an area corresponding to a resolution on an anode surface (=the surface of the anode substrate 111), it is necessary to suppress the expansion of electrons emitted from the electron source or prevent excessively spreading electrons from reaching the anode surface. A technique for the former condition is called a convergence technique of electron beams and a technique for the latter condition is called a trimming technique. Such techniques are reported in patent document 1, patent document 2, and so on.

Patent document 1 and patent document 2 describe convergence techniques in which a mesh electrode is provided between an electron source element and an anode electrode, electrons are drawn from the electron source element by applying a predetermined voltage to the mesh electrode, and electron beams from the mesh electrode to an anode surface are substantially aligned in a normal direction.

Patent documents 3 and 4 of the present inventor describe techniques in which out of electron beams emitted from an electron source, electron beams in a normal direction are selectively passed by forming an electric field distribution in a mesh structure, thereby suppressing the expansion of the electron beams on an anode surface.

Patent document 1: Japanese Patent Laid-Open No. 2000-048743

Patent document 2: Japanese Patent Laid-Open No. 2005-228556

Patent document 3: Japanese Patent Laid-Open No. 2007-250531

Patent document 4: Japanese Patent Laid-Open No. 2007-250532

DISCLOSURE OF THE INVENTION

Problem to be Solved by the Invention

In the foregoing configurations, the mesh electrode or the mesh structure improves the orthogonality of electron beams on the anode surface. However, even if electrons are all incident perpendicularly on the anode surface, the minimum size of an electron beam is determined by the size of the electron source element. Thus when the outside diameter of the electron beam is fixed, it is necessary to reduce the size of the electron source element to increase a resolution.

However, when the electron source element is reduced in size, the number of positionable emitters disadvantageously decreases.

Although the emitters may be reduced in size, the size reduction of the electron sources is limited to a certain degree and it is difficult to increase a resolution in view of an area necessary for an alignment margin in a photolithography process, a margin for dimension control in a process, and so on.

An object of the present invention is to provide a matrix-type cold-cathode electron source device that can increase a resolution without reducing the size of an electron source element as in the prior art.

Means for Solving the Problem

A matrix-type cold-cathode electron source device according to a first aspect of the present invention includes: a cold-cathode electron source array in which cold-cathode electron source elements with multiple emitters for emitting electrons are arranged in a matrix with a first pitch; a mesh structure opposed to the cold-cathode electron source array and having through-holes arranged with the first pitch; a target opposed to the cold-cathode electron source array via the mesh structure and set at a position colliding with electron beams having been emitted from the cold-cathode electron source array and passed through the through-holes of the mesh structure; and drive portions that drive the mesh structure in a first alignment direction and a second alignment direction of the through-hole.

A matrix-type cold-cathode electron source device according to a second aspect of the present invention, in the first aspect, wherein the drive portions drive the mesh structure to the first pitch in the first and second alignment directions every (1/N) (N is an integer of at least 2) of the first pitch.

A matrix-type cold-cathode electron source device according to a third aspect of the present invention, in the first or second aspect, wherein the mesh structure has one surface opposed to the cold-cathode electron source elements and the other surface opposed to the target, at least the surfaces of the mesh structure and the inner surfaces of the through-holes are covered with a conductive material, and a predetermined potential can be applied to the surface of the conductive material from the outside.

A matrix-type cold-cathode electron source device according to a fourth aspect of the present invention, in any one of the first to third aspects, wherein the mesh structure is 10 μm to 500 μm in thickness.

A matrix-type cold-cathode electron source device according to a fifth aspect of the present invention, in any one of the first to fourth aspects, wherein the through-holes of the mesh structure are substantially vertical in cross section in an electron beam direction.

A matrix-type cold-cathode electron source device according to a sixth aspect of the present invention, in one of the first and second aspects, wherein the mesh structure has one surface opposed to the cold-cathode electron source elements and the other surface opposed to the target, at least one of the surfaces of the mesh structure is covered with a conductive material, an insulating material is formed in contact with the surface covered with the conductive material, and a potential can be independently applied from the outside to the surface covered with the conductive material.

A matrix-type cold-cathode electron source device according to a seventh aspect of the present invention, in the sixth aspect, wherein the conductive material of the mesh structure is 10 μm to 500 μm in thickness and the insulating material of the mesh structure is 10 nm to 10 μm in thickness.

A matrix-type cold-cathode electron source device according to an eighth aspect of the present invention, in one of the first and second aspects, wherein the mesh structure has a base layer constituting a major part of the mesh structure and has one surface on which the base layer is opposed to the cold-cathode electron source elements and the other surface on which the base layer is opposed to the target, at least one of the surfaces of the mesh structure is covered with a conductive material having lower resistance than the base layer, and one of the material of the base layer and the material of the surfaces of the through-holes formed on the base layer has secondary electron emission capability.

A matrix-type cold-cathode electron source device according to a ninth aspect of the present invention, in the eighth aspect, wherein in the mesh structure, the base layer constituting the major part of the mesh structure is at least 50 μm in thickness.

A matrix-type cold-cathode electron source device according to a tenth aspect of the present invention, in the eighth aspect, wherein the through-holes of the mesh structure are substantially tapered in cross section with openings opposed to a target surface and the cold-cathode electron source array, and the openings opposed to the cold-cathode electron source array are larger in diameter than the openings opposed to the target surface.

A matrix-type cold-cathode electron source device according to an eleventh aspect of the present invention, in the eighth aspect, wherein a diameter D2 and a diameter D1 of a through-hole opening opposed to the cold-cathode electron source array have a relationship of $\tan\theta<(D2-D1)/(2*T)$, where T is the thickness of the mesh structure and θ is an angle of divergence of electrons emitted from a Spindt-type emitter.

A matrix-type cold-cathode electron source device according to a twelfth aspect of the present invention, in one of the first and second aspects, wherein the target has a phosphor film formed on a surface of the target.

A matrix-type cold-cathode electron source device according to a thirteenth aspect of the present invention, in one of the first and second aspects, wherein the target has a photoelectric conversion film formed on a surface of the target.

A matrix-type cold-cathode electron source device according to a fourteenth aspect of the present invention, in one of the first and second aspects, wherein the drive portions operate in synchronization with the electron emission of the cold-cathode electron source elements.

Advantage of the Invention

The present invention can achieve a matrix-type cold-cathode electron source device with high reliability by increasing a resolution without reducing the size of an electron source element, that is, without reducing the current density of the electron source element. Thus it is possible to obtain an FED with a high resolution and a high luminance and an image element with a high resolution and high sensitivity.

According to the configuration of one of claims 1 and 2, it is not necessary to reduce the area of the electron source element according to a resolution. Thus it is possible to stably obtain a sufficient amount of current and simultaneously reduce electrons emitted to a target surface, according to the opening diameter of a through-hole, thereby achieving an electron source device with a high resolution.

According to the configuration of claim 3, electrons emitted from a mesh structure to a target can be effectively transmitted to the target surface, thereby achieving an electron source device with high sensitivity.

According to the configuration of claim 4, it is possible to control the convergence of electrons passing through the mesh structure and simultaneously reduce the amount of electrons lost in collision with the mesh structure, thereby increasing a current density on the target surface. Further, it is possible to facilitate processing while keeping the strength of the mesh structure, thereby achieving reliability and yields in a manufacturing process.

According to the configuration of claim 5, it is possible to reduce electrons lost in the through-holes and transmit electrons with straightness to the target surface.

According to the configuration of claim 6, the paths of electrons passing through the mesh structure are controlled by an external electric field. Thus it is possible to control convergence and straightness, thereby achieving an electron source element with a high resolution.

According to the configuration of claim 7, it is possible to control the convergence of electrons passing through the mesh structure and simultaneously reduce the amount of electrons lost in collision with the mesh structure, thereby increasing a current density on the target surface. Further, it is possible to facilitate processing while keeping the strength of the mesh structure, thereby achieving reliability and yields in a manufacturing process.

According to the configuration of claim 8, even when electrons collide with the inner surfaces of the through-holes of the mesh structure, secondary electrons are emitted. Thus it is possible to keep a high current density without losing electrons.

According to the configuration of claim 9, it is possible to facilitate the fabrication of the mesh structure and keep the strength of the mesh structure, thereby achieving a matrix-type cold-cathode electron source device with reliability.

According to the configuration of claim 10, the secondary electrons generated on the inner surfaces of the through-holes are not scattered but are emitted to the target surface, thereby achieving a high current density and convergence.

According to the configuration of claim 11, electrons emitted from the electron source elements can be fully guided to the target surface, achieving a high current density.

According to the configuration of claim 12, a display device or an image device can be achieved with a high resolution.

According to the configuration of claim 13, an image device can be achieved a high resolution and high sensitivity.

According to the configuration of claim 14, a display device or an image device can be achieved with a high resolution.

BEST MODE FOR CARRYING OUT THE INVENTION

Referring to FIGS. 1 to 8, the following will describe embodiments of the present invention.

First Embodiment

FIGS. 1 to 4 show a matrix-type cold-cathode electron source device according to a first embodiment of the present invention.

Figure 1:
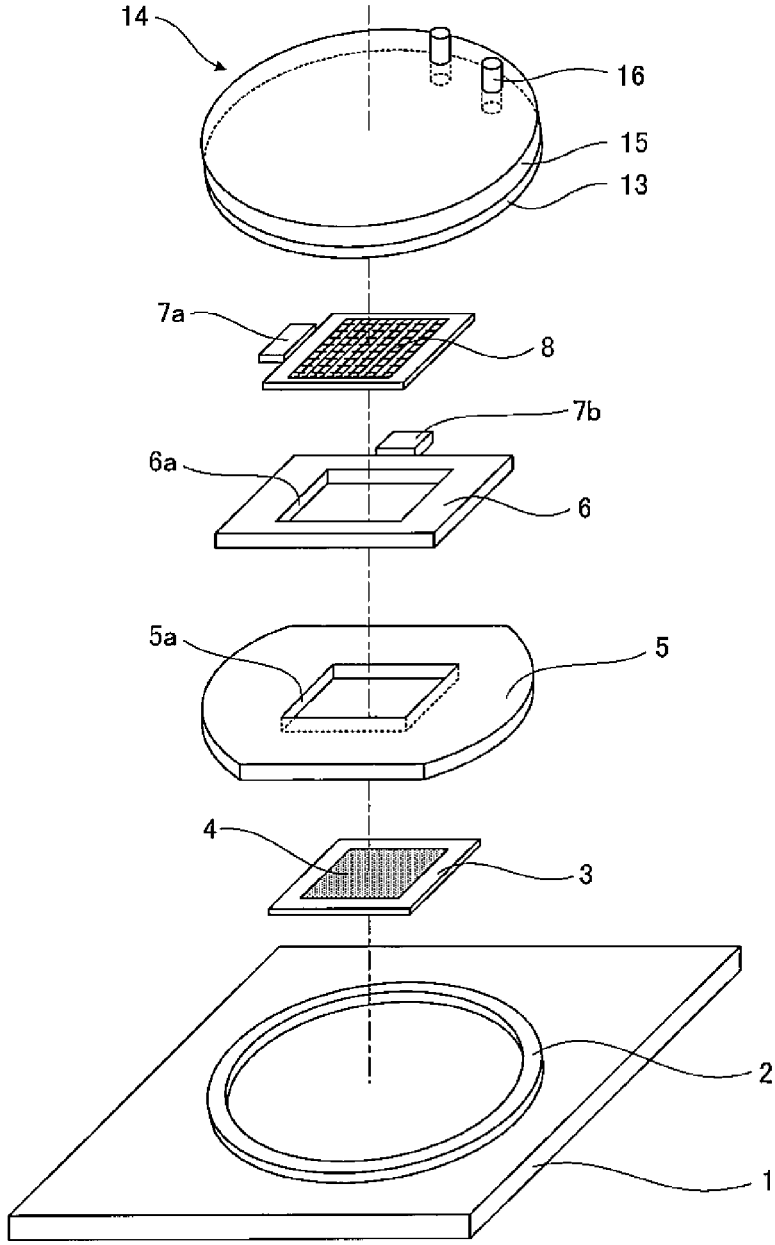
FIG. 1 is an exploded perspective view showing a matrix-type cold-cathode electron source device according to a first embodiment of the present invention.
Figure 2:
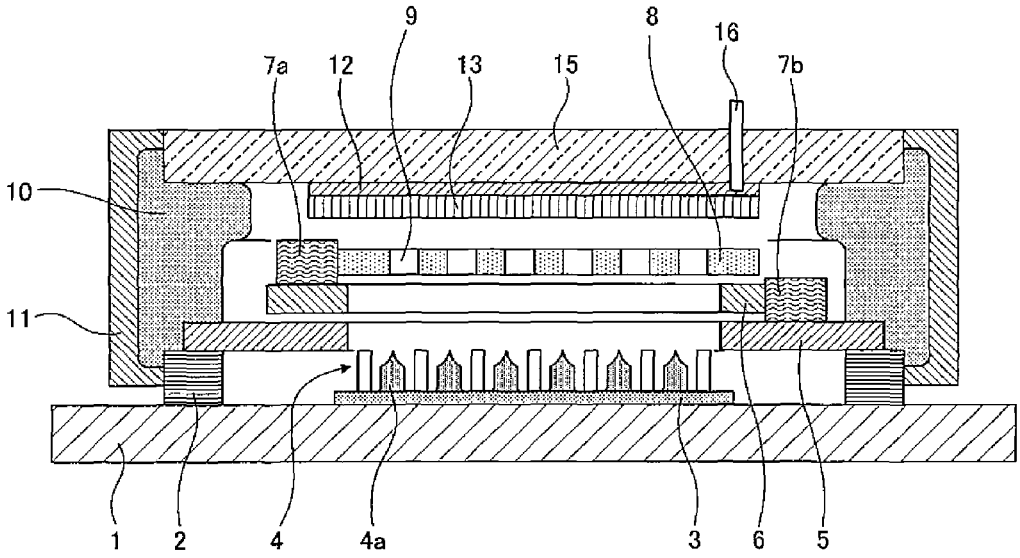
FIG. 2 is a schematic drawing showing the cross sectional configuration of the first embodiment.

FIG. 1 is an exploded perspective view and FIG. 2 is a sectional view showing the assembled electron source device.

On a back substrate 1, a ring glass spacer 2 is attached that is bonded with frit glass. Further, on the back substrate 1, a cold-cathode electron source array 4 is bonded with, e.g., silver paste inside the glass spacer 2.

The cold-cathode electron source array 4 is configured such that cold-cathode electron source elements 4*a* that is a group of emitters are arranged in a matrix in X and Y directions. In FIG. 2, each of the cold-cathode electron source elements 4*a* is illustrated as one emitter on a Si substrate 3 for the sake of simplicity. The cold-cathode electron source elements 4*a* are arranged in a matrix with a first pitch P1.

On the top surface of the glass spacer 2, a holding substrate 5 is set that has a window 5*a* formed at the center. The holding substrate 5 is fixed on the glass spacer 2 by an inner ring 10 made of a metal In and a stainless outer ring 11.

On the holding substrate 5, a Y-side actuator 7*b* is fixed that acts as a drive portion capable of moving a Y-side stage substrate 6 in Y-axis direction, the stage substrate 6 having a window 6*a* formed at the center. On the Y-side stage substrate 6, an X-side actuator 7*a* is fixed that acts as a drive portion capable of moving a mesh structure 8 in X-axis direction.

The mesh structure 8 is set on the holding substrate 5 via the X-side actuator 7*a* and the Y-side actuator 7*b*. The operations of the X-side actuator 7*a* and the Y-side actuator 7*b* can move the mesh structure 8 by predetermined distances in X and Y directions.

The mesh structure 8 has through-holes 9 formed at predetermined intervals in a matrix on a conductive thin plate acting as a base. The mesh structure 8 does not have to be fully conductive as long as at least the front and back sides of the mesh structure 8 and the inner surfaces of the through-holes possess conductivity. For example, a conductive film may be formed on a finely patterned glass surface by plating and the like.

Attached on the inner peripheries of the ends of the inner ring 10 and the stainless outer ring 11 is a front substrate 15. On the front substrate 15, a transparent conductive film 12 is formed so as to face the mesh structure 8 and is electrically connected to anode pins 16. On the surface of the transparent conductive film 12, a photoelectric conversion film 13 is formed. By applying a predetermined voltage to the anode pins 16 from the outside, the voltage can be applied to the photoelectric conversion film 13 through the transparent conductive film 12. A unit made up of the front substrate 15, the transparent conductive film 12, the photoelectric conversion film 13, and so on is a target 14 when viewed from the cold-cathode electron source array 4. The through-holes 9 are formed substantially in parallel with a line connecting the normal direction of the cold-cathode electron source array 4 and the front substrate 15.

During assembly, the inner ring 10 is interposed between the glass spacer 2 and the front substrate 15 and is pressed from above and below the back substrate 1 and the front substrate 15, so that the inner ring 10 is plastically deformed and a space surrounded by the back substrate 1, the glass spacer 2, the inner ring 10, and the front substrate 15 is sealed in an airtight manner. Since this operation is performed in a high vacuum, the cold-cathode electron source array 4 can be held in the high vacuum.

In an image device having the photoelectric conversion film 13 provided in the target 14, hole-electron pairs that have been induced by external light can be read by electrons emitted from the cold-cathode electron source array 4.

Figure 3:
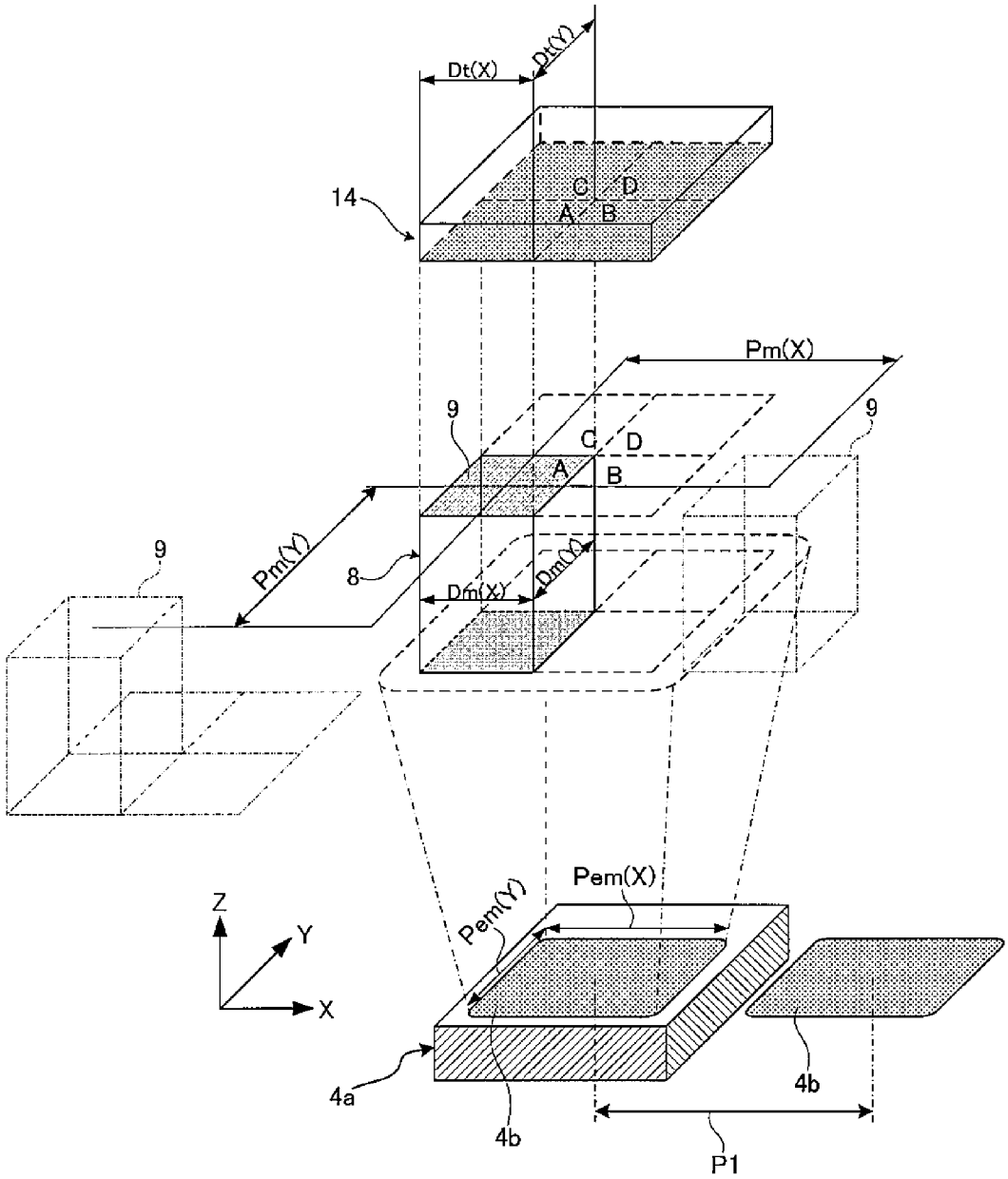
FIG. 3 is an exploded perspective view for explaining the functions of the first embodiment.

Referring to FIG. 3, the following will specifically describe the relationship among the mesh structure 8, the cold-cathode electron source element 4*a*, and the target 14. The cold-cathode electron source element 4*a* is configured as one of cells arranged in a matrix in the cold-cathode electron source array 4.

In the mesh structure 8, the through-holes 9 are formed in a matrix with the same pitch as the first pitch P1 of the cold-cathode electron source elements 4*a* of the cold-cathode electron source array 4. In FIG. 3, Pm(X) and Pm(Y) denote the pitches of the through-holes 9 in X and Y directions, the through-holes 9 being formed on the mesh structure 8. Dm(X) and Dm(Y) denote the widths the openings of the through-holes 9 in X and Y directions on the assumption that the through-holes 9 are formed substantially in the vertical direction. Further, Pem(X) and Pem(Y) denote the widths of an emitter region 4*b* of the cold-cathode electron source element 4*a*, which corresponds to one cell, in X and Y directions. In the case of a display device, Dt(X) and Dt(Y) denote the widths of an imaging surface of one pixel in X and Y directions, the pixel being illustrated as a virtual pixel on the target.

In the prior art, the emitter region 4*b* of the cold-cathode electron source element 4*a*, the through-holes 9, and the imaging region of one pixel on the target 14 are substantially equal in size and are expressed by the following relational expressions:

$$Pem(X) \approx Dm(X) \approx Dt(X)$$

$$Pem(Y) \approx Dm(Y) \approx Dt(Y)$$

In order to increase a resolution in a display device, it is necessary to reduce Dt(X) and Dt(Y). In other words, it is necessary to reduce Pem(X) and Pem(Y). However, it has been difficult to reduce the area of the cold-cathode electron source element because of, as previously mentioned, a limit on the degree of integration of the emitters and the serious influence of a process margin.

In a method of the present embodiment, the resolution of a display device can be doubled without changing the size of the cold-cathode electron source element 4*a*.

As shown in FIG. 3, the through-hole 9 of the mesh structure 8 is as large as one pixel of the target 14 and the emitter region 4*b* is substantially twice the size of the through-hole 9 in X and Y directions. In other words, the following relational expression is established:

$$Dm(X) \approx Dt(X) \approx (1/2)Pem(X)$$

$$Dm(Y) \approx Dt(Y) \approx (1/2)Pem(Y)$$

As previously mentioned, the mesh structure 8 is attached via the actuators 7*a* and 7*b*. The actuators 7*a* and 7*b* can move the mesh structure 8 by Pm(X) and Pm(Y) in X and Y directions. Pm(X) and Pm(Y) correspond to the pixel pitches of the cold-cathode electron source array 4 in X and Y directions. In other words, the mesh structure 8 is moved to regions A, B, C, and D of FIG. 3 by the actuators 7*a* and 7*b* in synchronization with the electron emission of the cold-cathode electron source element 4*a*, so that the regions A, B, C, and D of the target can be irradiated with electron beams.

The mesh structure 8 configured thus makes it possible to use one pixel of the prior art as four pixels, thereby increasing a resolution without reducing the size of the cold-cathode electron source element 4*a*.

The following will briefly describe the configurations and timing operations of the actuators 7*a* and 7*b* and the electron source array 4 when the cold-cathode electron source element 4*a* is used as a display element of an FED and the like.

The mesh structure 8 is opposed to the cold-cathode electron source array 4. The through-holes 9 have multiple through-holes arranged with the first pitch P1. The target 14 is opposed to the mesh structure 8 and is set at a position colliding with electron beams that are emitted from the cold-cathode electron source array 4 and pass through the through-holes 9 of the mesh structure 8. The X-side actuator 7*a* and the Y-side actuator 7*b* act as drive portions that move the mesh structure 8 in a first alignment direction (X axis) and a second alignment direction (Y axis) of the through-hole 9. The opening diameter of the through-hole 9 is set at or below 1/N (N is an integer of at least 2) of the first pitch. The mesh structure 8 is driven every (1/N) of the first pitch by the X-side actuator 7*a* and the Y-side actuator 7*b* in the first and second alignment directions (X axis and Y axis). The X-side actuator 7*a* and the Y-side actuator 7*b* are sequentially fixed on the holding substrate 5 in a stacked manner, so that the mesh structure 8 can be two-dimensionally driven independently in X and Y directions. In this example, the cold-cathode electron source element 4*a* is used as a display element of an FED and the like. The cold-cathode electron source element 4*a* may be used as an imaging element with the same configuration and timing operations as a display element.

The following will describe the case where an image is displayed as a moving image according to the NTSC standard.

In the screen display of NTSC, successive image frame signals in frames of 1/30 seconds are sequentially displayed in real time. The display operation is a simple matrix display operation of simultaneously displaying horizontal signals for the respective vertical scanning signal lines (480 in NTSC) of each frame. When the mesh structure 8 of the present embodiment is used, the display time (about 69.4 μsec) of the vertical signal scanning lines for one frame is divided into two and the halved frames are displayed at double speed. At this point, it is necessary to synchronize the display operation with the driving of the actuators. The first display operation is performed using the openings (through-hole 9) of the actuators (about 34.7 μsec), the mesh structure 8 is moved by a distance (Pm(X)) corresponding to the pixel pitch, and then a display operation is performed on the subsequent pixel. According to the operating principle, the openings of the mesh structure enable display operations on two pixels in X and Y directions, respectively.

The mesh structure 8 is used and driven thus in synchronization with image display, so that one pixel in the prior art can be used as four pixels. Therefore, it is possible to advantageously increase a resolution without reducing the size of the cold-cathode electron source element 4*a*.

A resolution increased thus by the mesh structure is advantageous in view of a stable operation and the reliability of the cold-cathode electron source.

Generally, in a matrix-type cold-cathode electron source device, driving wires are provided in X and Y directions to separately control the operations of cold-cathode electron source elements arranged in a matrix. Further, the matrix-type cold-cathode electron source device includes gate electrodes for applying an electric field to the ends of emitters and contact portions with the driving wires, though the matrix-type cold-cathode electron source device may slightly vary in configuration depending on the kind of electron source element. When an element is configured by stacking different flat constituent elements in the vertical direction, it is necessary to align the flat constituent elements of different shapes. This alignment requires a design produced in consideration of a displacement between the constituent elements and an amount of displacement is generally called an alignment margin.

The larger the number of stacked constituent elements, the larger the space for the alignment margin. In an electron source element, an increase in the number of emitters leads to a large amount of current and stability. However, the larger the space for the alignment margin, the smaller the space for forming emitters. Thus, for example, when the area of the electron source element is reduced by half, the number of emitters is reduced by more than half, that is, to 30% to 40%, so that it is difficult to obtain a required amount of current or it is necessary to increase a load on each emitter to obtain a required amount of current.

To address this problem in the present embodiment, the area of the through-hole 9 is reduced to one quarter while keeping constant the area of the electron source element, thereby achieving a higher resolution. Unlike in the method of the prior art in which the area of the electron source element is reduced by half, the present embodiment makes it possible to keep a relatively high current density, so that the electron source element can be stably operated and the life of the electron source can be increased with ease.

In the present embodiment, a resolution is determined by the size of the through-hole 9 of the mesh structure 8. In the size reduction of the mesh structure 8, a semiconductor process or an MEMS (Micro Electro Mechanical systems) technique is necessary. The mesh structure 8 requires only micromachining on the through-holes 9 but do not require any alignment margins unlike the cold-cathode electron source elements 4*a*, so that the mesh structure 8 can be easily reduced in size.

In the prior art, the through-holes 9 are adjacent to each other with a pixel pitch. Thus in the size reduction of the prior art, walls holding the through-holes 9 are extremely reduced in thickness. In the present embodiment, the through-holes 9 are spaced at driving pitches and thus it is possible to obtain relatively thick walls and improve the reliability of strength.

The present embodiment described an example in which the electron source element is doubled in size in X and Y directions relative to the through-hole. The size increase of the electron source element is not limited to twice. An integral multiple of at least 2 is not deviated from the requirements of the present invention in consideration of a request from a process of obtaining a through-hole size calculated from the start of electron beams and a designed through-hole size.

In the present embodiment, the through-holes 9 are substantially vertical in cross section. The opening dimensions of the through-hole are not always equal between the electron source array side and the target side. A difference of plus or minus 10% to 20% is inevitable in the range of shape control of a process.

Figure 4:
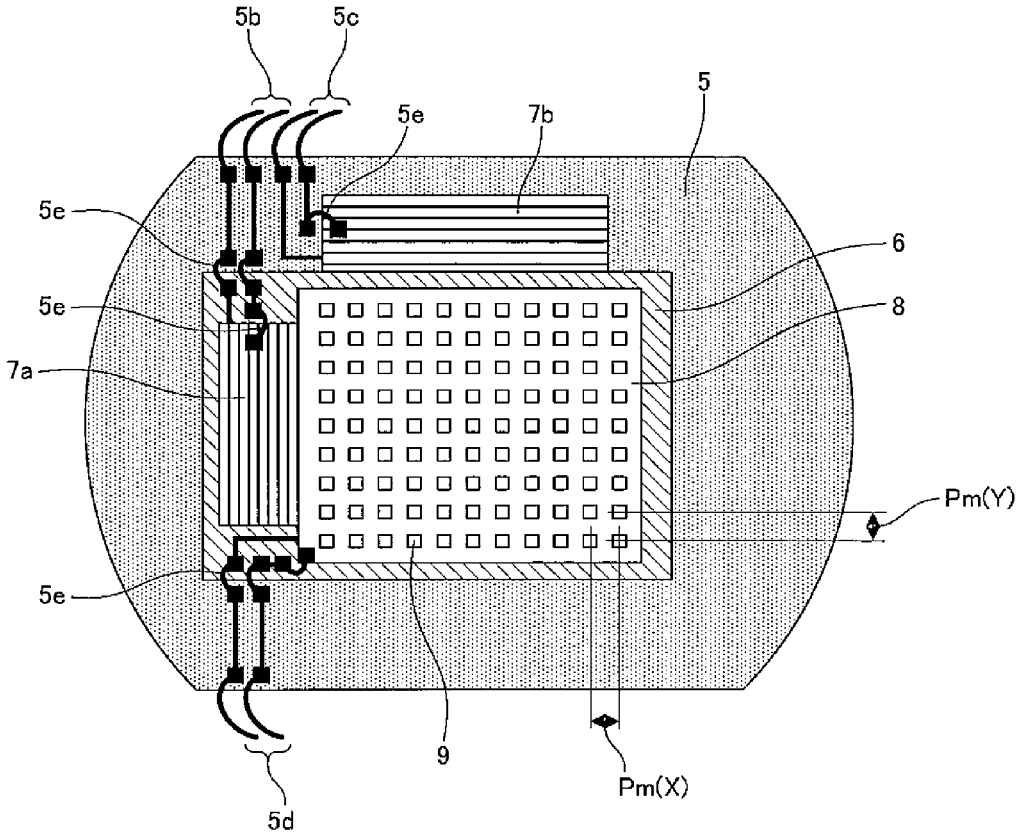
FIG. 4 is a principle-part plan view for explaining the configuration and the driving method of the first embodiment.

Referring to FIGS. 1, 2, and 4, a driving method of the mesh structure 8 will be briefly described below.

The X-side actuator 7*a* is attached to the mesh structure 8 and only the X-side actuator 7*a* is fixed on the Y-side stage substrate 6. With this configuration, the mesh structure 8 can be moved on the Y-side stage substrate 6 by any distance in X direction.

The Y-side actuator 7*b* is attached to the Y-side stage substrate 6 and only the Y-side actuator 7*b* is fixed on the holding substrate 5. With this configuration, the Y-side stage substrate 6 can be moved on the holding substrate 5 by any distance in Y direction.

This configuration can move the mesh structure 8 by any distance in X and Y directions relative to the holding substrate 5. Since the holding substrate 5 is fixed on the glass spacer 2 by the inner ring 10, the mesh structure 8 can be moved to any position in X and Y directions relative to the cold-cathode electron source array 4.

In the present embodiment, the X-side actuator 7*a* and the Y-side actuator 7*b* are piezo-electric devices. The piezo-electric devices can be reduced in size and can obtain a movement of several tens μm by the application of several tens V, thereby achieving a movement for the electron source device of the present embodiment.

As shown in FIG. 4, signal wires for driving the actuators are connected by drawing wires for driving the X-side actuator, drawing wires 5*c* for driving the Y-side actuator, mesh electrode drawing wires 5*d*, and bonding wires 5*e* for vertically connecting the substrates, the drawing wires 5*b*, 5*c*, and 5*d* being formed on the holding substrate 5 and the Y-side stage substrate 6. The signal wires are simultaneously connected via bonding wires to electrode wires (not shown) that are formed from the holding substrate 5 onto the back substrate 1, so that external signals are supplied through the signal wires. A potential is supplied to the mesh structure 8 by a similar technique.

The actuators are piezo-electric devices in the present embodiment. The actuators are not limited to piezo-electric devices. For example, actuators other than piezo-electric devices may be used or a fine direct-acting mechanism and the like may be used according to an MEMS technique. Further, in the present embodiment, the mesh structure and the X-side actuator are used as separate components but may be integrated according to the MEMS technique. Similarly, the Y—side stage substrate and the Y-side actuator may be integrated.

Second Embodiment

FIGS. 5A to 5E show a specific example of the mesh structure 8 of the first embodiment.

Figure 5A:
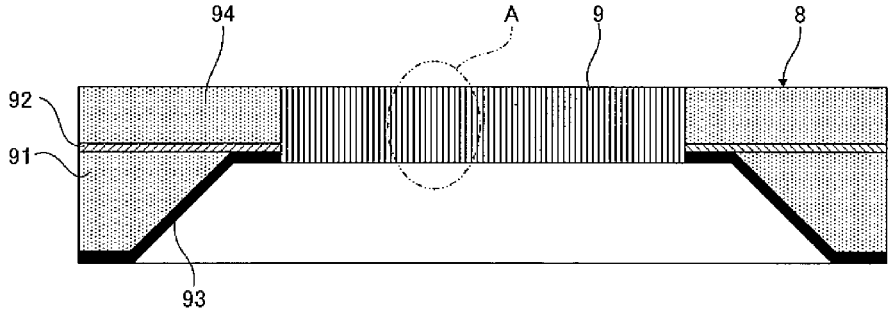
FIG. 5A is a sectional view showing the mesh structure of a matrix-type cold-cathode electron source device according to a second embodiment of the present invention.
Figure 5B:
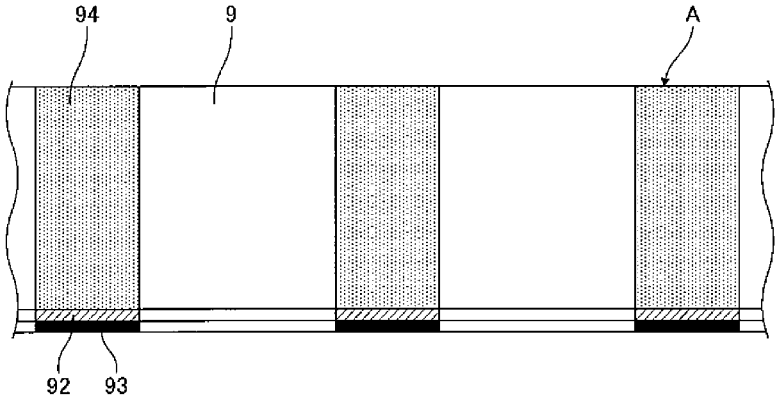
FIG. 5B is an enlarged sectional view showing through-holes according to another example of the mesh structure of the second embodiment.

FIG. 5A is a schematic sectional view of the mesh structure 8. FIG. 5B is an enlarged sectional view schematically showing a through-hole portion A of FIG. 5A.

The mesh structure 8 has a three-layer structure made up of a first electrode 93 that is a conductive layer opposed to a cold-cathode electron source array 4, an insulating layer 92 serving as an intermediate layer, and a second electrode 94 that is a conductive layer opposed to a target 14.

The first electrode 93 and the second electrode 94 can independently control potentials. By properly controlling the potentials, the target 14 can be efficiently irradiated with electrons emitted from the cold-cathode electron source array 4 with maintained convergence, so that a high resolution can be obtained.

The convergence of electron beams in the mesh structure 8 is affected not only by the distribution of potentials applied to the first electrode 93 and the second electrode 94 but also by the thicknesses of the first electrode 93, the insulating layer 92, and the second electrode 94. Further, the convergence is affected by a distance between the cold-cathode electron source array and the first electrode 93 and a distance between the second electrode 94 and the surface of a target. Thus it is necessary to make the optimum design by using a method such as an electric field simulation. Since the design items are not equivalent to the requirements of the present invention, the explanation thereof is omitted.

The mesh structure 8 configured thus is fabricated as follows:

First, an SOI (Silicon on Insulator) substrate is prepared in which single crystal Si having a predetermined thickness is formed on a base single-crystal Si substrate via an intermediate insulating layer.

The thickness of an insulating material constituting the mesh structure 8 is set at the optimum value in a range of 10 nm to 10 μm. In order to allow the mesh structure 8 to optimally converge electron beams, it is necessary to optimally design the thicknesses of the first electrode 93, the insulating layer 92, and the second electrode 94 as well as the distribution of potentials applied to the first electrode 93 and the second electrode 94. The first electrode 93 and the second electrode 94 receive different potentials and are caused to statically act as lenses on the paths of electron beams. When the insulating material is a silicon oxide film used in a silicon semiconductor process, high insulation and resistance can be advantageously obtained for the applied potentials. For example, when the used silicon oxide film has a thickness of 10 nm, the silicon oxide film has a withstand voltage characteristic of about 50 V. When the silicon oxide film has a thickness of 10 μm, the silicon oxide film has a high withstand voltage characteristic of about 50 kV. Thus the design becomes more flexible relative to a thickness.

In this case, an SOI substrate was purchased in which a base Si substrate had a thickness of 200 μm, an intermediate insulating layer had a thickness of 2 μm, and single crystal Si formed on the insulating layer had a thickness of 100 μm, and then a mesh structure was fabricated in which an insulating film had a thickness of 10 μm. The base Si substrate of the SOI substrate corresponds to the base Si substrate 91, the intermediate insulating layer corresponds to the insulating layer 92, and the single crystal Si formed on the intermediate insulating layer corresponds to the second electrode 94. The second electrode 94 is reduced in resistance by injecting a high concentration of phosphorus and an N-type impurity such as arsenic into the single crystal Si.

A resist film serving as a protective film or an SOG (Spin on Grass) film is applied over the surface of the second electrode 94 formed of the single crystal Si. After that, a resist film having predetermined openings is applied on the back side of the base Si substrate 91, and then wet etching is performed from the back side of the base Si substrate 91 (the underside of FIG. 5A) by using potassium hydroxide (KOH). The speed of etching using KOH varies with the crystal faces of the Si single crystal. Thus on a single crystal substrate with a plain direction (100), an etching surface is formed that is substantially tapered by about 42°. The insulating layer 92 cannot be etched by KOH and thus etching having performed on the Si substrate is stopped at the insulating layer 92. After the resist is fully exfoliated, a metal film serving as the first electrode 93 is formed on the overall back side of the base Si 91. In the present embodiment, the metal film is made of Al with a thickness of 1 μm.

Next, an oxide film having a thickness of 100 nm is formed on the surface of the second electrode 94, a resist film is applied thereon, and then openings corresponding to through-holes 9 are formed thereon. The oxide film is first etched and then the through-holes 9 are formed by successively etching the second electrode 94, the insulating layer 92, and the first electrode 93 by dry etching with the resist and the oxide film serving as a mask, so that the mesh structure 8 is completed.

The mesh structure 8 focuses electrons emitted from the cold-cathode electron source array 4 and transmits the electrons to the target 14 by separately applying voltages to the first electrode 93 and the second electrode 94. The convergence of electrons can be determined by a distance between cold-cathode electron source element 4*a* formed in the cold-cathode electron source array 4 and the surface of the first electrode 93 set at the bottom of the through-hole 9, a voltage applied to the first electrode 93, the thickness of the insulating layer 92, the thickness and applied voltage of the second electrode 94, and a distance between the top surface of the second electrode 94 and a photoelectric conversion film 13 formed on the target 14. In the present embodiment, the specifications of the SOI substrate are determined beforehand and thus a distance between the cold-cathode electron source element 4*a* formed in the cold-cathode electron source array 4 and the first electrode 93 set at the bottom of the through-hole 9 can be adjusted by the thickness of the first electrode 93. The through-holes 9 are formed by a semiconductor processing technique and thus enable micromachining.

Figure 5C:
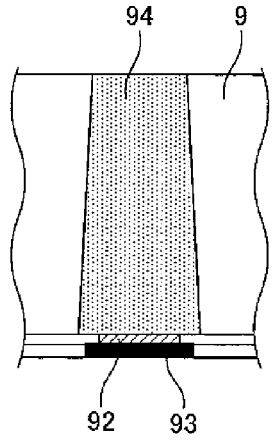
FIG. 5C is an enlarged sectional view showing a through-hole according to another example of the mesh structure of the second embodiment.
Figure 5D:
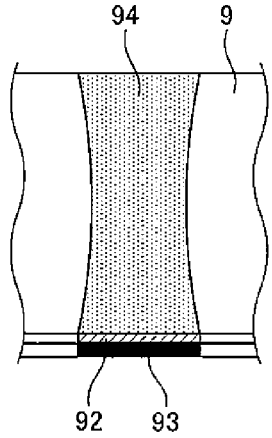
FIG. 5D is an enlarged sectional view showing a through-hole according to another example of the mesh structure of the second embodiment.
Figure 5E:
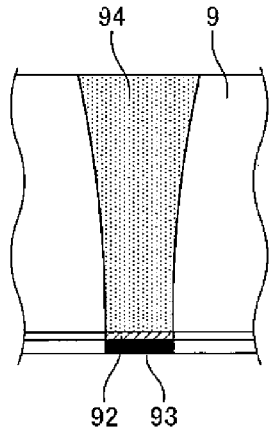
FIG. 5E is an enlarged sectional view showing a through-hole according to another example of the mesh structure of the second embodiment.

In the example of FIG. 5B, the through-hole 9 has a constant diameter from the entrance to the exit in cross section, that is, the through-hole 9 is substantially vertical in an electron beam direction (Z-axis). The through-hole 9 may be configured as follows:

FIGS. 5C to 5E show examples of the cross sectional shape of the through-hole 9 in the mesh structure 8. The cross sectional shape of the through-hole 9 can be varied with the materials and etching methods of the second electrode 94, the insulating layer 92, and the first electrode 93. As shown in FIG. 5C, the opening of the through-hole 9 may be expanded toward the target surface. As shown in FIG. 5D, the second electrode 94 may be constricted in the middle. As shown in FIG. 5E, the opening of the through-hole 9 may be narrowed toward the target surface while being curved. As previously mentioned, these shapes are design items but are not equivalent to the requirements of the present invention. Thus the explanation thereof is omitted.

Third Embodiment

FIGS. 6A, 6B, 7A, and 7B show a third embodiment of the present invention.

The present embodiment is different from the foregoing embodiments in the cross sectional shapes of through-holes 9 in a mesh structure 8. Other configurations are identical to those of the first embodiment.

Figure 6A:
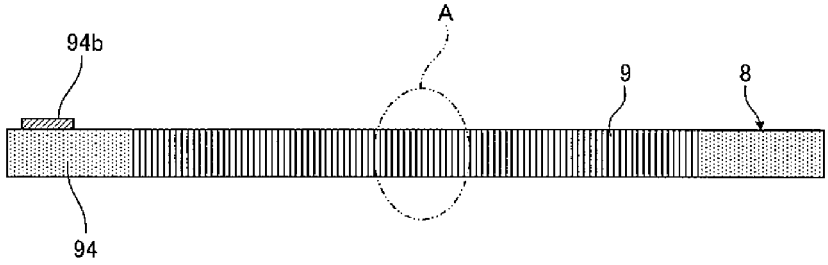
FIG. 6A is a schematic drawing showing the cross section of a mesh structure of a matrix-type cold-cathode electron source device according to a third embodiment of the present invention.
Figure 6B:
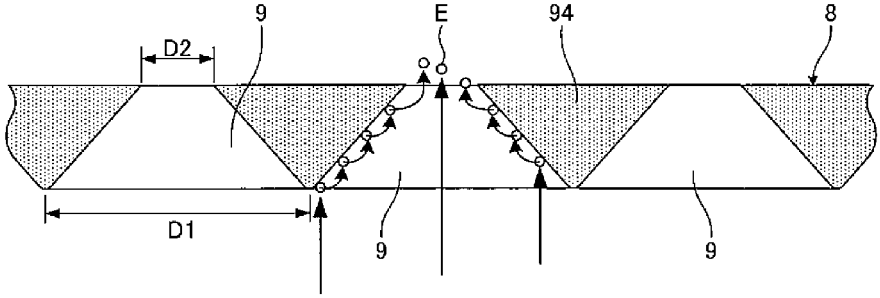
FIG. 6B is an enlarge sectional view of through-holes and an explanatory drawing showing the behaviors of electrons according to the third embodiment.

As shown in FIG. 6B, the through-hole 9 of the third embodiment expands toward a cold-cathode electron source array 4 and narrows toward a target 14, that is, the through-hole 9 is substantially tapered. Further, at least the inner surface of the through-hole 9 is made of a material having a secondary electron emission capability exceeding 1.

FIG. 6A shows the overall mesh structure 8 made of the same material. Reference character 94*b* denotes a second electrode drawing pad. FIG. 6B is an enlarged sectional view schematically showing a through-hole portion A of FIG. 6A.

The mesh structure 8 is formed on condition that a base layer constituting a major part of the mesh structure 8 is at least 50 μm in thickness. When the mesh structure is fabricated using an MEMS manufacturing line, it is desirable to maximize the size of a used wafer (at least 4 inches) to reduce the manufacturing unit cost of a structure. In the case of the process of the second embodiment, it is requested to prevent damage and scratches on a wafer during the transportation of the wafer in each production apparatus. When microelectrodes having through-hole structures are fabricated on a wafer, the mechanical strength of the wafer considerably decreases and the wafer may be damaged. By setting the thickness of the base layer of the mesh structure 8 at 50 μm or larger, it is possible to sufficiently keep the mechanical strength of the wafer even after the formation of the microstructure, so that the wafer is hardly damaged.

In FIG. 6B, when the through-hole 9 has an opening opposed to the cold-cathode electron source array 4 with a diameter of D1 and an opening opposed to the target 14 with a diameter of D2, as previously mentioned, D2 is substantially equal to a pixel dimension determined based on a request of a resolution. Some of electron beams emitted from the cold-cathode electron source elements 4*a* do not collide with the inner surfaces of the through-holes 9 but directly reach the surface of the target 14, and others collide with the inner surfaces of the substantially tapered through-holes 9. At this point, when the material of the mesh structure 8 has secondary electron emission capability of 1 or less, electrons having collided with the inner surfaces are directly absorbed by the mesh structure 8 and are not emitted to the target 14. In the present embodiment, the material of the mesh structure 8 has secondary electron emission capability exceeding 1. Thus secondary electrons are generated by electrons E having collided with the inner surfaces of the through-holes 9. The generated secondary electrons directly travel toward the target 14 as being close to the openings opposed to the target 14. When the secondary electrons travel away from the target 14, the electrons collide with the inner surfaces of the through-holes 9 again and another secondary electrons are generated. This phenomenon is repeated, and the generated secondary electrons travel toward the target 14 when reaching the openings opposed to the target 14.

In the present embodiment, a predetermined voltage is applied to the mesh structure 8 in order to effectively prevent electrons emitted from the cold-cathode electron source elements 4*a* from returning to the cold-cathode electron source elements 4*a*. In this case, the mesh structure 8 acts as a second electrode 94.

The substantially tapered through-holes 9 are processed as follows:

First, a resist is applied to one of the surfaces of a metal plate made of, e.g., SUS and openings are formed thereon by a photolithography process so as to correspond to D2 of the through-holes 9. Further, a resist is applied over the other surface of the metal plate. The metal plate is soaked, for a predetermined time, into a chemical solution prepared by adding a resist dissolving component to a solution for etching the metal plate. Thus the openings of the resist are expanded such that the resist is gradually dissolved along with etching in the thickness direction of the metal plate; meanwhile, etching is performed on a part where the resist has dissolved on the metal plate. When the metal plate is fully etched in the thickness direction, the metal plate is removed from the etching solution and is subjected to predetermined cleaning, and then the resist is peeled off. Thus the through-holes 9 are obtained with substantially the same cross sectional shapes as in FIGS. 6A and 6B.

In the embodiment of FIGS. 6A and 6B, it is only necessary to form the substantially tapered through-holes on the mesh structure 8, achieving simple fabrication.

Figure 7A:
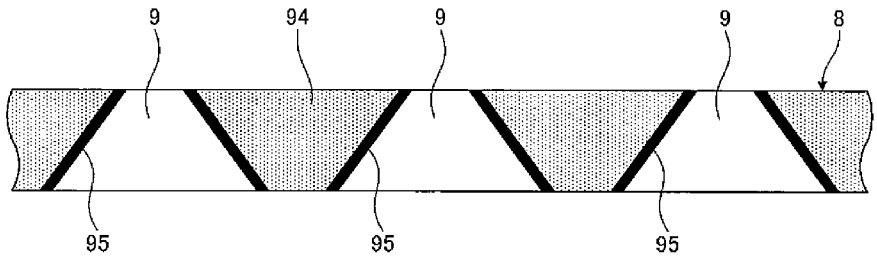
FIG. 7A is an enlarged sectional view showing through-holes according to another example of the third embodiment.
Figure 7B:
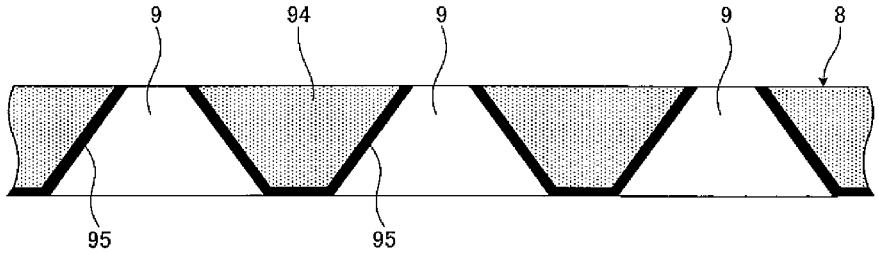
FIG. 7B is an enlarged sectional view showing through-holes according to another example of the third embodiment.

FIGS. 7A and 7B show another example of the third embodiment.

FIG. 7A shows that the material of the mesh structure 8 is a Si substrate having high micro machinability. Since Si has low secondary electron emission capability, secondary electron emission films 95 such as MgO films are formed on the inner surfaces of the through-holes 9. The secondary electron emission film 95 has high secondary electron emission capability. The secondary electron emission films 95 are formed on the inner surfaces of the through-holes 9 as follows: in the manufacturing method of the second embodiment, etching is completed, the etching solution is removed by a predetermined method, cleaning is performed, and the secondary electron emission films 95 are formed with a predetermined thickness from the larger openings by vacuum deposition with the resist left on the films. The resist is peeled off thereafter, so that the mesh structure 8 can be fabricated with the secondary electron emission films 95 formed only on the inner surfaces of the through-holes 9. When the secondary electron emission films 95 is formed of a material by plating, plating is performed with the resist left on the films, so that the mesh structure 8 can be fabricated with the same configuration.

In FIG. 7B, the secondary electron emission films 95 are formed on the undersides of the second electrodes 94 as well as the inner surfaces of the through-holes 9. With this configuration, secondary electrons are generated from electrons having collided with the undersides of the secondary electron emission films 95 out of electrons emitted from the cold-cathode electron source elements 4*a*. Thus it is possible to obtain a large amount of current for the target 14.

The mesh structure having a thickness of T preferably satisfies the following relationship:

$$\tan\theta < (D2-D1)/(2*T) \quad \text{(Formula A)}$$

where D2 is the diameter of a through-hole opening opposed to the target 14, D1 is the diameter of a through-hole opening opposed to the cold-cathode electron source array 4, and θ is an angle of divergence of electrons emitted from Spindt-type emitters.

The trimming effect of electron beams in the mesh structure will be described below according to the relational expression.

In the case of Spindt-type emitters, generally, an angle of emission of electrons from the emitters has an angle of divergence of 30° on one side substantially in the vertical direction.

When the thickness of the mesh structure is sufficiently larger than the opening diameters (T>>D1, D2), the trimming effect of electron beams can be sufficiently obtained as long as the opening diameters D2 and D1 of the through-hole are equal to each other.

However, mesh structures are generally fabricated using a semiconductor material and process. Thus in reality, the thickness of the mesh structure is limited to a value as large as or several times as large as the opening diameter. In this case, the divergent components of electron beams cannot be trimmed by the mesh structure, so that a resolution may decrease.

The mesh structure is fabricated so as to satisfy (Formula A), so that most of the divergent components of electron beams theoretically collide with the side walls of the through-holes of the mesh structure, and are absorbed and removed on the side walls. Thus electron beams traveling to the target through the through-holes are trimmed substantially into collimated beams and a constant high resolution can be expected.

Fourth Embodiment

Figure 8:
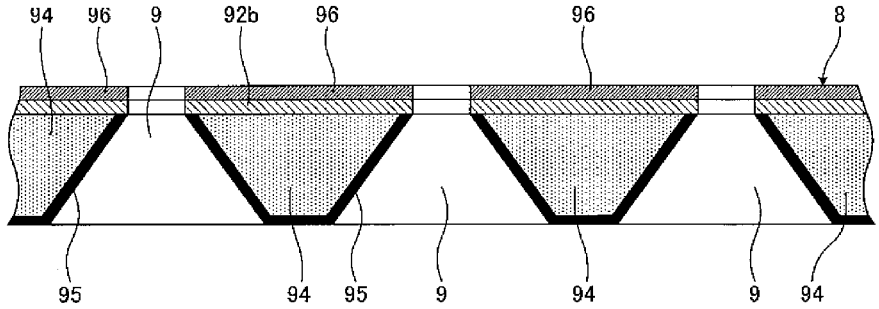
FIG. 8 is an enlarged sectional view showing through-holes in a mesh structure of a matrix-type cold-cathode electron source device according to a fourth embodiment of the present invention.
Figure 9:
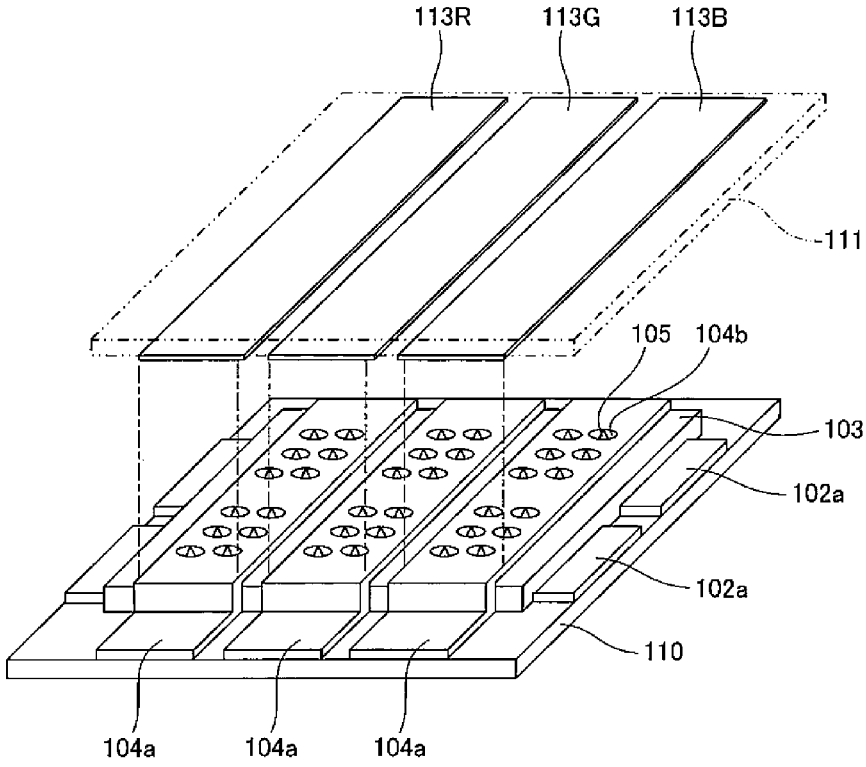
FIG. 9 PRIOR ART
FIG. 9 is an enlarged perspective view showing the basic configuration of an FED according to the prior art.
Figure 10:
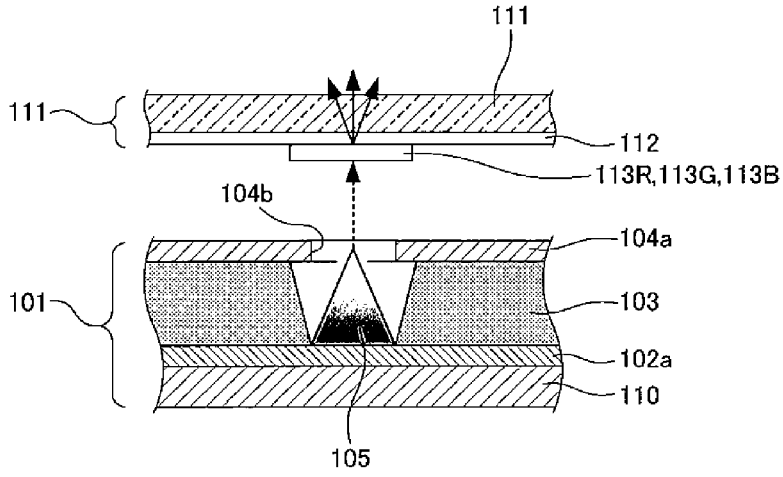
FIG. 10 PRIOR ART
FIG. 10 is a sectional view of the prior art.

FIG. 8 shows a fourth embodiment of the present invention.

The fourth embodiment is different from the foregoing embodiments in the cross sectional shapes of through-holes 9 in a mesh structure 8. Other configurations are identical to those of the third embodiment.

In the fourth embodiment, the through-holes 9 formed in the mesh structure 8 are tapered such that the through-holes 9 are expanded toward a cold-cathode electron source array 4 and are narrowed toward a target 14, and at least the inner surfaces of the through-holes 9 are made of a material having secondary electron emission capability exceeding 1. This configuration is identical to that of the third embodiment. Further, in the present embodiment, third electrodes 96 are formed via an insulating layer 92*b* on a surface of the mesh structure 8 such that the third electrodes 96 face the target 14. In this configuration, electrons emitted from cold-cathode electron source elements 4*a* collide with the substantially tapered through-holes 9 that act as second electrodes 94. On the inner surfaces of the tapered through-holes 9, films are formed with secondary electron emission capability exceeding 1 and secondary electrons are emitted by the collision of electrons.

In this configuration, the second electrodes 94 and the third electrodes 96 are set at a predetermined potential. Thus advantageously, the generated secondary electrons can be efficiently drawn to the target 14 and the electrons pass through the through-holes 9 with higher convergence.

The through-holes 9 are processed as follows:

First, the insulating layer 92*b* is formed on the surface of a base Si substrate 91 (on the top surface in FIG. 8) by a thermal oxidation method. Next, a resist is applied to the back side of the base Si substrate 91 (the underside in FIG. 8) and openings are formed thereon with a predetermined diameter. After that, wet etching is performed using KOH until the insulating layer 92*b* is exposed. At this point, monocrystalline Si is anisotropically etched relative to a crystal face, so that shapes are formed with a cone angle of about 42°.

After the resist is peeled off, the tapered surface of Si is coated with a negative resist and then the overall insulating layer 92*b* is exposed to light from the top surface. After that, the development of the resist leaves the resist under the insulating layer 92*b* and removes the resist on the back side of the base Si substrate 91. In this state, a MgO film or the like with high secondary electron emission capability is formed on the back side of the base Si substrate 91 by vacuum deposition and the like, and then the resist is peeled off, so that the secondary electron emission films 95 are formed only on the back side of the base Si substrate 91.

After that, a negative resist is applied on the surface of the insulating layer 92*b* and the resist is developed by exposing the overall resist to light from the Si substrate side, leaving the resist only on the tapered openings of the Si substrate. In this state, a metal film of, e.g., Cr is formed with a predetermined thickness on the insulating layer 92*b* and the patterned surface of the resist film by vacuum deposition, and then the resist is peeled off. Thus the metal film formed on the surface of the resist is removed along with the resist. Next, the insulating layer 92*b* is etched to form openings with the metal film of, e.g., Cr serving as a mask, so that the mesh structure 8 is completed.

With this configuration, electron beams emitted from the cold-cathode electron source element 4 are not absorbed by the mesh structure 8 and thus it is possible to supply electron beams of substantially the same amount to a target surface as an amount of electron beams emitted from the cold-cathode electron source element 4. Further, by setting the second electrodes 94 and the third electrodes 96 at a predetermined potential, it is possible to efficiently control secondary electrons generated on the inner surfaces of the through-holes 9 and the paths of electrons, thereby improving a current density and a resolution on the surface of the target 14.

As previously mentioned, the mesh structure 8 is moved by a distance corresponding to a pitch of a resolution. Thus as compared with the case where the electron source element is configured as large as one pixel of the prior art, it is possible to supply most of electron beams to one pixel from the electron source element as large as an integral multiple of the pixel, thereby achieving a large electron beam amount and a high resolution.

In the foregoing embodiments, an image device was illustrated as a specific example of a matrix-type cold-cathode electron source device. The present invention can be similarly implemented for an FED in which a phosphor film is formed instead of the photoelectric conversion film 13 on the surface of the target 14.

INDUSTRIAL APPLICABILITY

The present invention can contribute to an increase in the resolution of, e.g., a field emission display device and a sensitive image device in which a principle part is a matrix-type electron source device using a cold cathode.

The invention claimed is:

1. A matrix-type cold-cathode electron source device comprising:

a cold-cathode electron source array in which cold-cathode electron source elements with multiple emitters for emitting electrons are arranged in a matrix with a first pitch;

a mesh structure opposed to the cold-cathode electron source array and having through-holes arranged with the first pitch;

a target opposed to the cold-cathode electron source array via the mesh structure and set at a position colliding with electron beams emitted from the cold-cathode electron source array and passed through the through-holes of the mesh structure; and drive portions that drive the mesh structure in a first alignment direction and a second alignment direction of the through-hole, wherein the target has a transparent conductive film as an anode and a photoelectric conversion film formed at the side of the mesh structure of the transparent conductive film, and the drive portions drive the mesh structure a distance up to the first pitch in the first and second alignment directions in increments of (1/N) (N is an integer of at least 2) of the first pitch.

2. The matrix-type cold-cathode electron source device according to claim 1, wherein the mesh structure is 10 μm to 500 μm in thickness.

3. The matrix-type cold-cathode electron source device according to claim 1, wherein the through-holes of the mesh structure are substantially vertical in cross section in an electron beam direction.

4. The matrix-type cold-cathode electron source device according to claim 1, wherein the mesh structure has one surface opposed to the cold-cathode electron source elements and an other surface opposed to the target, at least one of the surfaces of the mesh structure is covered with a conductive material, an insulating material is formed in contact with the surface covered with the conductive material, and a potential can be independently applied from an outside to the surface covered with the conductive material.

5. The matrix-type cold-cathode electron source device according to claim 4, wherein the conductive material of the mesh structure is 10 μm to 500 μm in thickness and the insulating material of the mesh structure is 10 nm to 10 μm in thickness.

6. The matrix-type cold-cathode electron source device according to claim 1, wherein the mesh structure has a base layer constituting a major part of the mesh structure and has one surface on which the base layer is opposed to the cold-cathode electron source elements and an other surface on which the base layer is opposed to the target, at least one of the surfaces of the mesh structure is covered with a conductive material having lower resistance than the base layer, and one of a material of the base layer and a material of surfaces of the through-holes formed on the base layer has secondary electron emission capability.

7. The matrix-type cold-cathode electron source device according to claim 6, wherein in the mesh structure, the base layer constituting the major part of the mesh structure is at least 50 μm in thickness.

8. The matrix-type cold-cathode electron source device according to claim 6, wherein the through-holes of the mesh structure are substantially tapered in cross section with openings opposed to a target surface and the cold-cathode electron source array, and the openings opposed to the cold-cathode electron source array are larger in diameter than the openings opposed to the target surface.

9. The matrix-type cold-cathode electron source device according to claim 6, wherein the through-hole substantially tapered in cross section has an opening diameter D2 opposed to a target surface and an opening diameter D1 opposed to the cold-cathode electron source array, D1 and D2 having a relationship of:

$$\tan\theta < (D2 - D1)/(2*T)$$

where T is a thickness of the mesh structure and θ is an angle of divergence of electrons emitted from a Spindt-type emitter.

10. A matrix-type cold-cathode electron source device comprising:

a cold-cathode electron source array in which cold-cathode electron source elements with multiple emitters for emitting electrons are arranged in a matrix with a first pitch;

a mesh structure opposed to the cold-cathode electron source array and having through-holes arranged with the first pitch;

a target opposed to the cold-cathode electron source array via the mesh structure and set at a position colliding with electron beams emitted from the cold-cathode electron source array and passed through the through-holes of the mesh structure; and drive portions that drive the mesh structure in a first alignment direction and a second alignment direction of the through-hole, wherein the target has a transparent conductive film as an anode and a phosphor film formed at the side of the mesh structure of the transparent conductive film, the drive portions drive the mesh structure a distance up to the first pitch in the first and second alignment directions in increments of (1/N) (N is an integer of at least 2) of the first pitch.

11. The matrix-type cold-cathode electron source device according to claim 1, wherein the drive portions operate in synchronization with electron emission of the cold-cathode electron source elements.

12. The matrix-type cold-cathode electron source device according to claim 10, wherein the mesh structure is 10 pm to 500 pm in thickness.

13. The matrix-type cold-cathode electron source device according to claim 10, wherein the through-holes of the mesh structure are substantially vertical in cross section in an electron beam direction.

14. The matrix-type cold-cathode electron source device according to claim 10, wherein the mesh structure has one surface opposed to the cold-cathode electron source elements and an other surface opposed to the target, at least one of the surfaces of the mesh structure is covered with a conductive material, an insulating material is formed in contact with the surface covered with the conductive material, and a potential can be independently applied from an outside to the surface covered with the conductive material.

15. The matrix-type cold-cathode electron source device according to claim 10, wherein the mesh structure has a base layer constituting a major part of the mesh structure and has one surface on which the base layer is opposed to the cold-cathode electron source elements and an other surface on which the base layer is opposed to the target, at least one of the surfaces of the mesh structure is covered with a conductive material having lower resistance than the base layer, and one of a material of the base layer and a material of surfaces of the through-holes formed on the base layer has secondary electron emission capability.

16. The matrix-type cold-cathode electron source device according to claim 10, wherein the drive portions operate in synchronization with electron emission of the cold-cathode electron source elements.

* * * * *